US009417569B2

(12) United States Patent
Okuno et al.

(10) Patent No.: US 9,417,569 B2
(45) Date of Patent: Aug. 16, 2016

(54) FUSER AND IMAGE FORMING APPARATUS

(71) Applicant: KONICA MINOLTA, INC., Chiyoda-ku, Tokyo (JP)

(72) Inventors: Jinju Okuno, Toyohashi (JP); Toshiya Aoki, Toyokawa (JP); Ryohei Matsuo, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/694,479

(22) Filed: Apr. 23, 2015

(65) Prior Publication Data

US 2015/0323891 A1 Nov. 12, 2015

(30) Foreign Application Priority Data

May 12, 2014 (JP) ..... 2014-098801

(51) Int. Cl.
*G03G 15/20* (2006.01)

(52) U.S. Cl.
CPC ..... *G03G 15/20* (2013.01); *G03G 15/2053* (2013.01)

(58) Field of Classification Search
CPC ..... G03G 15/2053; G03G 15/205; G03G 15/2039; G03G 15/2078
See application file for complete search history.

(56) References Cited

U.S. PATENT DOCUMENTS 7,283,757 B2 * 10/2007 Fujimoto ..... G03G 15/2053 219/619
2007/0047983 A1 * 3/2007 Itoh ..... G03G 15/2039 399/33
2013/0195477 A1 * 8/2013 Seshita ..... G03G 15/205 399/33

FOREIGN PATENT DOCUMENTS

JP 2008027594 A 2/2008
JP 2009276570 A 11/2009

* cited by examiner

*Primary Examiner* — Sandra Brase
(74) *Attorney, Agent, or Firm* — Holtz, Holtz & Volek PC

(57) ABSTRACT

A fuser for thermally fixing a toner image on a recording medium includes: an endless fusing belt configured to transfer heat to the toner image; a heat source configured to heat the fusing belt; a detection unit configured to detect peripheral inward deformation of the fusing belt; and a power cut-off unit configured to cut off power supplied to the heat source upon detection of the peripheral inward deformation of the fusing belt by the detection unit.

15 Claims, 6 Drawing Sheets

1A, 1B, 1C, 1D, 1E

FUSER AND IMAGE FORMING APPARATUS

The entire disclosure of Japanese Patent Application No. 2014-098801 filed on May 12, 2014 including description, claims, drawings, and abstract are incorporated herein by reference in its entirety.

BACKGROUND OF THE INVENTION

1. Field of the Invention

The present invention relates to a fuser and an image forming apparatus, and more particularly to a fuser having a fusing belt and an image forming apparatus including the fuser.

2. Description of the Related Art

Generally, an electrophotographic image forming apparatuses includes a fuser for thermally fixing a toner image transferred to a printed medium to the printed medium. A fuser of this kind includes an endless fusing belt configured to transfer heat to a toner image, a pressure roller configured to hold the printed medium having the toner image transferred thereon, between the pressure roller and the fusing belt, and a heat source configured to heat the fusing belt. In addition, in order to prevent ignition caused by abnormal overheating of the fusing belt, the fuser also includes a detection unit provided on the outer peripheral side of the fusing belt, and detect abnormal overheating of the fusing belt by monitoring the temperature of the fusing belt, and a mechanism for cutting off power supplied to the heat source based on the temperature of the fusing belt detected by the detection unit. As one of such fusers, a fuser described in JP 2009-276570 A (hereinafter, referred to as conventional fuser) is known.

When the temperature of the fusing belt is raised by abnormal heating of the heat source, the fusing belt tends to expand at an initial stage, and finally ignite through contraction. Upon contraction of the fusing belt, the fusing belt and the detection unit provided on the outer peripheral side are separated in distance, so that measurement of the temperature by the detection unit is made difficult, and detection of the abnormal overheating of the fusing belt is delayed. In order to prevent such a situation, the conventional fuser is provided with a guide member near the detection unit and on the inner peripheral side of the fusing belt to prevent separation in distance between the fusing belt and the detection unit. However, since the conventional fuser is provided with the guide member, heat from the heat source reaches the fusing belt through the guide member, and rise in temperature of the fusing belt near the guide member is delayed relative to temperature rise at the other part of the fusing belt. Accordingly, the conventional fuser has a problem that the delayed detection of the abnormal overheating of the fusing belt by the detection unit cannot prevent the ignition of the fusing belt.

SUMMARY OF THE INVENTION

It is an object of the present invention to provide a fuser configured to accurately detect abnormal overheating of a fusing belt, and prevent ignition of the fusing belt, and an image forming apparatus including the fuser.

To achieve the abovementioned object, according to an aspect, a fuser for thermally fixing a toner image on a recording medium reflecting one aspect of the present invention comprises: an endless fusing belt configured to transfer heat to the toner image; a heat source configured to heat the fusing belt; a detection unit configured to detect peripheral inward deformation of the fusing belt; and a power cut-off unit configured to cut off power supplied to the heat source upon detection of the peripheral inward deformation of the fusing belt by the detection unit.

According to another aspect of the present invention, an image forming apparatus preferably includes the fuser.

The fuser according to an embodiment of the present invention includes a detection unit configured to detect peripheral inward deformation of the fusing belt, and a power cut-off unit configured to cut off power supply to a heat source upon detection of the peripheral inward deformation of the fusing belt. Accordingly, the fuser according to an embodiment of the present invention detects the peripheral inward deformation of the fusing belt, and overcomes the problem with the above-mentioned fuser having a mechanism for cutting off power to the heat source based on monitoring the temperature of the fusing belt. That is, the fuser according to an embodiment of the present invention can accurately detect the abnormal overheating of the fusing belt, and prevent the ignition of the fusing belt.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described with reference to the drawings. However, the scope of the invention is not limited to the illustrated examples.

First Embodiment

Schematic Configuration of Image Forming Apparatus

Figure 1:
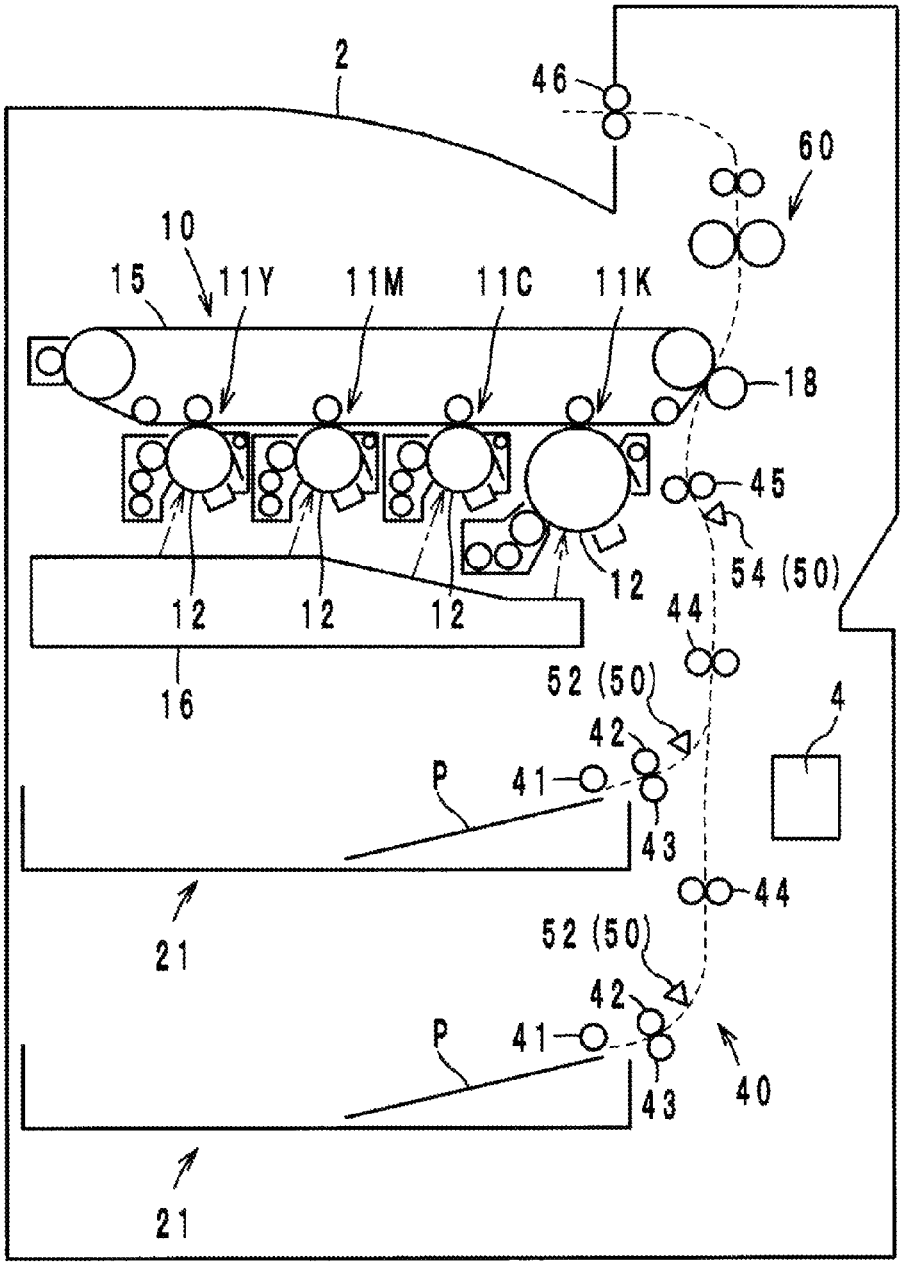
FIG. 1 is a schematic view illustrating an inner structure of an image forming apparatus.

See FIG. 1

An image forming apparatus 1A according to a first embodiment will be described below with reference to the drawings. It is noted that in the drawings, the same components or portions are denoted by the same reference signs, and description thereof will be omitted.

As illustrated in FIG. 1, the image forming apparatus 1A is an electrophotographic color printer. The image forming apparatus 1A includes a control unit 4 configured to control each portion and each unit of the image forming apparatus 1A, an image forming section 10, two paper feed cassettes 21, a conveyance unit 40, a sensing unit 50 and a fuser 60.

The image forming section 10 includes image forming units 11Y, 11M, 11C, and 11K disposed respectively with charging devices, developing devices, or the like around photoreceptor drums 12 configured to form images of yellow (Y), magenta (M), cyan (C), and black (K) colors, an intermediate transfer belt 15 configured to primarily transfer toner images formed at the image forming units 11Y, 11M, 11C, and 11K and combine the transferred toner images, a secondary transfer roller 18 configured to secondarily transfer the combined toner image from the intermediate transfer belt to a paper sheet P (recording medium), and an exposure unit 16 using a laser beam. It is noted that the configuration and function of an image forming section 10 of this kind is conventionally well known, and detailed description thereof will be omitted.

The paper feed cassette 21 is a box-shaped case in which paper sheets P are stacked, and is provided to be drawn from a front side (front side of FIG. 1) of the image forming apparatus 1.

The conveyance unit 40 is configured to convey the paper sheets P in the image forming apparatus, and includes a pickup roller 41, a paper feed roller 42, a separation roller 43, a conveyance roller pair 44, a timing roller pair 45, and an exit roller pair 46. In the conveyance unit 40, one paper sheet P on the uppermost layer of the paper sheets P stacked in the paper feed cassette 21 is picked up by the pickup roller 41, and fed by the paper feed roller 42 and the separation roller 43. Further, the fed paper sheet P is conveyed downstream of a conveyance direction by the conveyance roller pair 44, and fed from the timing roller pair 45 to the secondary transfer roller 18. The secondary transfer roller 18 applies an electric field, and the toner image on the intermediate transfer belt 15 is transferred to the paper sheet P. Then, the paper sheet P is fed to the fuser 60 for thermal fusing of toner, and output by the exit roller pair 46 into a paper output tray 2 provided on an upper surface of the image forming apparatus 1.

The sensing unit 50 includes a paper feed sensor 52 positioned between the paper feed roller 42 and the conveyance roller pair 44, and a registration sensor 54 positioned immediately in front of the timing roller pair 45. Both of the paper feed sensor 52 and the registration sensor 54 detect passage or arrival of the paper sheet P being conveyed.

Figure 2:
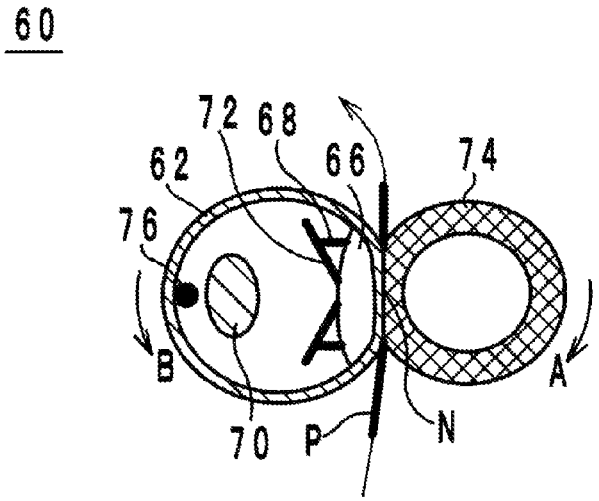
FIG. 2 is a cross-sectional view of a fuser according to a first embodiment.
Figure 3:
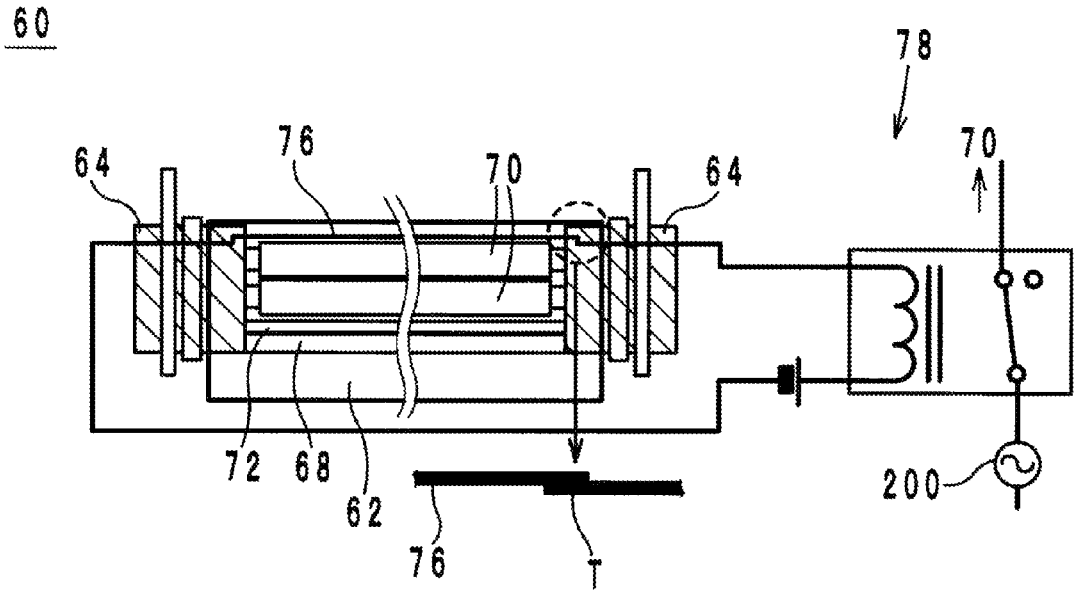
FIG. 3 is a schematic view illustrating an inner structure of the fuser according to the first embodiment, and a connection relationship with a power cut-off unit.
Figure 4:
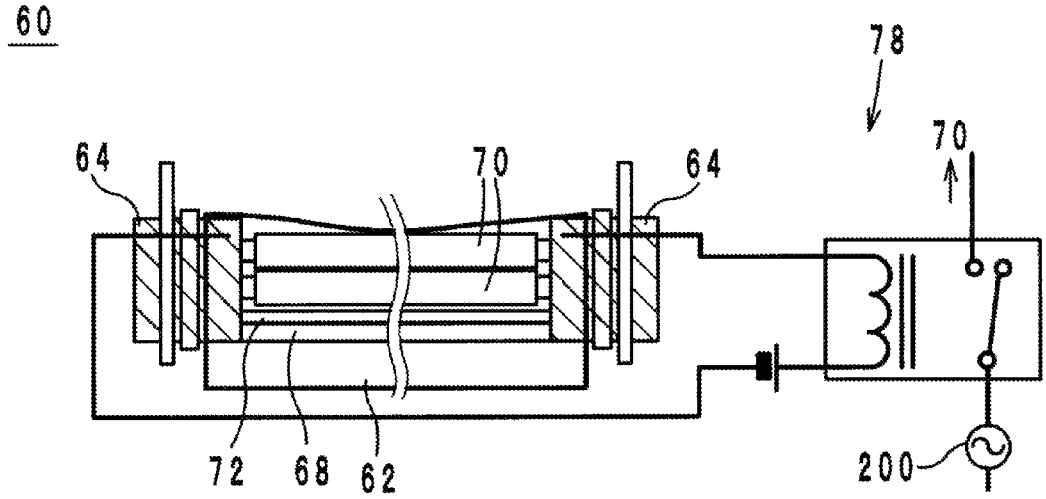
FIG. 4 is a schematic view illustrating the inner structure of the fuser according to the first embodiment, and a connection relationship with the power cut-off unit.

(Detailed Description of Fuser, See FIGS. 2 to 4)

As illustrated in FIG. 2, the fuser 60 is configured such that the paper sheet P having the toner image transferred thereon is held between a fusing belt 62 and a pressure roller 74. Then the toner image is fixed on the paper sheet P by heat from the fusing belt 62. Further, the fuser 60 includes a belt guide 64, a pad 66, a holding plate 68, a halogen heater 70, a reflection plate 72, a detection unit 76, and a power cut-off unit 78, in addition to the fusing belt 62 and the pressure roller 74.

The fusing belt 62 includes a release layer having a base layer including a heat resistant resin such as polyimide, an elastic layer including for example silicone rubber on the base layer, and a surface layer including for example PFA. Additionally, the fusing belt 62 is held in substantially a circular shape by the belt guides 64 disposed either end of the fusing belt 62 in a width direction as illustrated in FIG. 3, and the pad 66 provided on the inner peripheral side of the fusing belt 62 illustrated in FIG. 2, and extending in the width direction.

The holding plate 68 is provided on the inner peripheral side of the fusing belt 62 along the pad 66 for compensation of the rigidity of the pad 66, holds the pad 66, and has both ends fixed to the belt guides 64 connected to a frame of an apparatus body.

The halogen heater (heat source) 70 and the reflection plate 72 are provided on the inner peripheral side of the fusing belt 62 to irradiate the fusing belt 62 with infrared light. Radiant heat of the infrared light heats the fusing belt 62. It is noted that, in the present embodiment, the halogen heater 70 is positioned on one side of an inner periphery of the fusing belt 62, and the pad 66 and the holding plate 68 are provided on the other side of the inner periphery across the reflection plate 72.

As illustrated in FIG. 2, the pressure roller 74 forms, together with the fusing belt 62, a nip portion N configured to hold the paper sheet P therein. Additionally, the pressure roller 74 is rotationally driven in a direction indicated by an arrow A, and this rotational driven force drives the fusing belt 62 to be rotated in a direction indicated by an arrow B, while maintaining the substantially circular shape. It is noted that the paper sheet P is conveyed to the nip portion N, while holding a surface having the toner transferred thereon, toward the fusing belt 62.

The detection unit 76 is configured to detect contraction of the fusing belt 62 (peripheral inward deformation of the belt) immediately before ignition of the belt. Additionally, the detection unit 76 is a conductive rod-shaped member, and provided at a place (on one side) between the inner peripheral surface of the fusing belt 62 and the halogen heater 70. As illustrated in FIG. 3, the detection unit 76 extends in the width direction of the fusing belt 62. Additionally, both ends of the detection unit 76 are connected to terminals T of the power cut-off unit 78 described below. Specifically, the terminals T of the power cut-off unit 78 are disposed in rod insertion holes provided in the belt guides 64. Both ends of the detection unit 76 as the rod-shaped member are inserted into the rod insertion holes of the belt guides 64, respectively, and the ends of the detection unit 76 are put on the terminals T of the power cut-off unit 78, and connected with the terminal T by their own weight.

The power cut-off unit 78 is a so-called relay (drive circuit) for controlling power supply, received from an AC voltage source (power supply) 200, to the halogen heater 70. Normally, the detection unit 76 is in contact with the terminals T of the power cut-off unit 78 by its own weight. In this condition, the detection unit 76 and the power cut-off unit 78 form a closed circuit, and the power supply to the halogen heater 70 is maintained.

However, when the fusing belt 62 is abnormally overheated and contracted, the inner peripheral surface of the fusing belt 62 makes contact with the detection unit 76, and the detection unit 76 is pressed toward the inner periphery of the fusing belt 62. Therefore, the detection unit 76 having a rod shape is bent, and finally separated from and comes off the terminals T of the power cut-off unit 78. As a result, as illustrated in FIG. 4, the circuit formed by the detection unit 76 and the power cut-off unit 78 is changed from the closed circuit to an open circuit, and power supply to the halogen heater 70 is stopped by the power cut-off unit 78. That is, the detection unit 76 as the rod-shaped member is disposed to be operated as described above at a position where the detection unit 76 makes contact with part of the fusing belt 62 deformed and moved peripherally inward.

(Effect)

In the fuser 60 and the image forming apparatus 1A including the fuser 60, when the fusing belt 62 is deformed peripherally inward, the detection unit 76 having the rod shape is pressed peripherally inward, bent, and finally comes off. As a result, the circuit including the detection unit 76 and the power cut-off unit 78 is changed to the open circuit, and the power supply to the halogen heater 70 is stopped. That is, in the fuser 60 and the image forming apparatus 1A including the fuser 60, the peripheral inward deformation of the fusing belt 62 is directly detected, and the power supply to the halogen heater 70 is stopped based on the detection of the deformation. Accordingly, the fuser 60 and the image forming apparatus 1A including the fuser 60 overcomes the problem with the conventional fuser having the mechanism for cutting off power supplied to the heat source based on monitoring of temperature of the fusing belt, for example, difficulty in measurement of the temperature by the detection unit due to separation in distance between the fusing belt and the detection unit provided on the outer peripheral side of the fusing belt. That is, the fuser 60 and the image forming apparatus 1A including the fuser 60 can further accurately detect the abnormal overheating of the fusing belt 62, and prevent the ignition of the fusing belt 62.

Further, the detection unit 76 is provided on one side of the inner periphery of the fusing belt 62 where the halogen heater 70 is positioned. The one side where the halogen heater 70 is positioned has a temperature higher than that of the other side where the pad 66 and the holding plate 68 are positioned. Accordingly, in the fuser 60 and the image forming apparatus 1A including the fuser 60, the detection unit 76 is provided at a part of the fusing belt 62 where the temperature tends to rise, so that the detection unit 76 can detect the contraction caused by the abnormal overheating of the fusing belt 62 earlier, and can prevent the ignition of the fusing belt 62, compared with the detection unit provided at the other part of the fusing belt 62.

Second Embodiment

Figure 5:
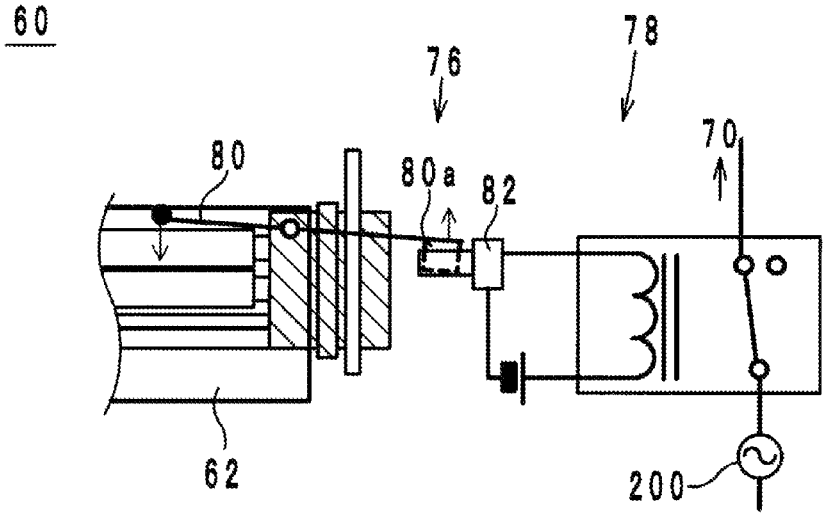
FIG. 5 is a schematic view illustrating an inner structure of the fuser according to a second embodiment, and a connection relationship with the power cut-off unit.
Figure 6:
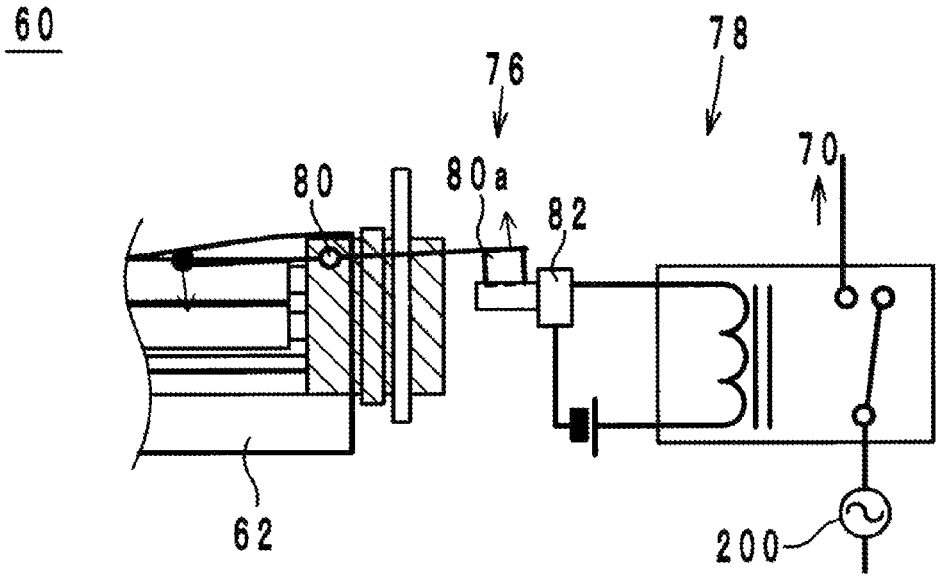
FIG. 6 is a schematic view illustrating the inner structure of the fuser according to the second embodiment, and a connection relationship with the power cut-off unit.

See FIGS. 5 and 6

An image forming apparatus 1B according to a second embodiment and the image forming apparatus 1A according to the first embodiment are different in configuration of the detection unit 76 of the fuser 60. The detection unit 76 according to the second embodiment includes a lever 80, and an optical sensor 82 having a set of a light emitting element and a light receiving element. Detailed description will be made below.

As illustrated in FIG. 5, the lever 80 of the detection unit 76 according to a second embodiment has one side positioned on the inner peripheral side of the fusing belt 62. Additionally, the lever 80 has the other side mounted with a plate-shaped member 80*a* configured to block light from the light emitting element of the optical sensor 82. Normally, the light from the light emitting element is blocked by the plate-shaped member 80*a*, and power is supplied to the halogen heater 70.

However, as illustrated in FIG. 6, when the fusing belt 62 is abnormally overheated and contracted, the inner peripheral surface of the fusing belt 62 makes contact with the one side of the lever 80 of the detection unit 76. In this condition, the one side of the lever 80 is pressed toward the inner periphery of the fusing belt 62. When the one side of the lever 80 is pressed, the other side of the lever 80 is moved around the fulcrum, accompanied by movement of the plate-shaped member 80*a* blocking light from the light emitting element of the optical sensor 82. Accordingly, blocking of the light from the light emitting element by the plate-shaped member 80*a* is released, and the light from the light emitting element is received at the light receiving element. When the light is received by the light receiving element, a signal is generated. The power cut-off unit 78 receives the signal to be operated, and power supply to the halogen heater 70 is stopped.

Even in the image forming apparatus 1B configured as described above, the abnormal overheating of the fusing belt 62 can be detected further accurately, and the ignition of the fusing belt 62 can be prevented. The other configurations of the present second embodiment are similar to those of the first embodiment. Accordingly, description of the present second embodiment is identical to that of the first embodiment except for the detection unit 76.

Third Embodiment

Figure 7:
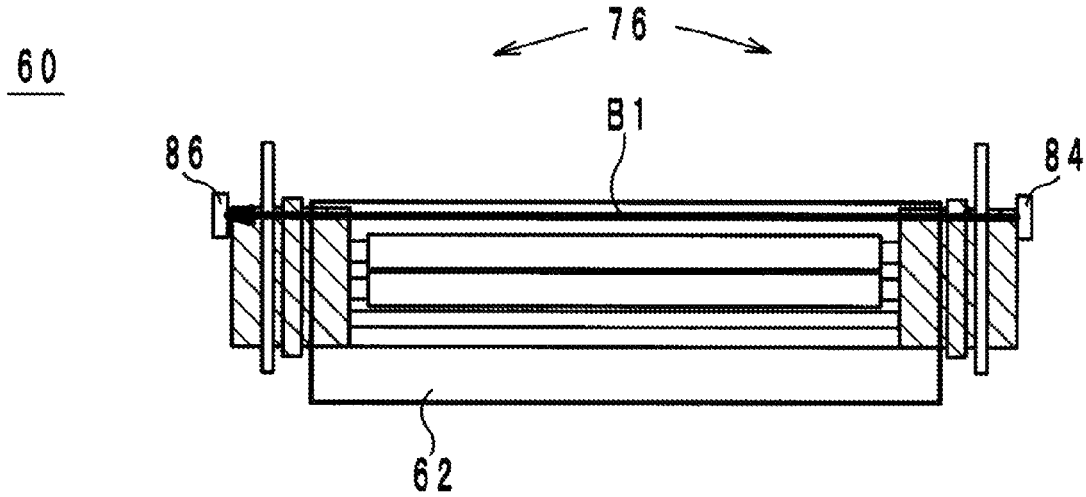
FIG. 7 is a schematic view illustrating an inner structure of the fuser according to a third embodiment.
Figure 8:
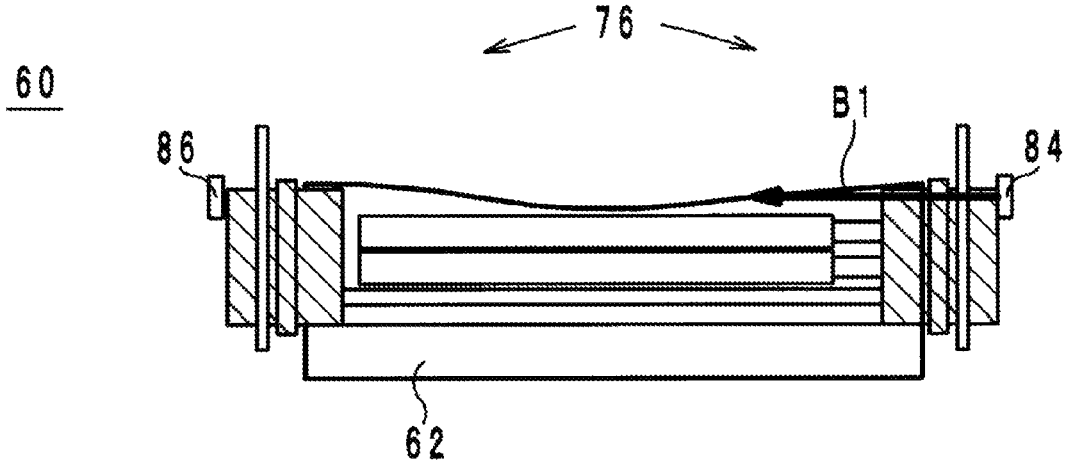
FIG. 8 is a schematic view illustrating the inner structure of the fuser according to the third embodiment.

See FIGS. 7 and 8

An image forming apparatus 1C according to a third embodiment and the image forming apparatus 1A according to the first embodiment are different in configuration of the detection unit 76 of the fuser 60. The detection unit 76 according to the third embodiment includes an optical sensor having a set of a light emitting element 84 and a light receiving element 86. Detailed description will be made below.

As illustrated in FIG. 7, in the detection unit 76 according to the third embodiment, the light emitting element 84 is provided at the belt guide 64 on one end side of the fusing belt 62 in a width direction, and the light receiving element 86 is provided at the belt guide 64 on the other end side. Normally, light B1 from the light emitting element 84 is received at the light receiving element 86. In this condition, the power supply to the halogen heater 70 is maintained.

However, as illustrated in FIG. 8, when the fusing belt 62 is abnormally overheated and contracted, the inner peripheral surface of the fusing belt 62 intrudes an optical path of the light B1. Therefore, the light from the light emitting element 84 is blocked. Accordingly, a signal is generated from the light receiving element 86, the power cut-off unit 78 receiving the signal is operated, and the power supply to the halogen heater 70 is stopped.

Even in the image forming apparatus 1C configured as described above, the abnormal overheating of the fusing belt 62 can be detected further accurately, and the ignition of the fusing belt 62 can be prevented. The other configurations of the present third embodiment are similar to those of the first embodiment. Accordingly, description of the present third embodiment is identical to that of the first embodiment except for the detection unit 76.

Fourth Embodiment

Figure 9:
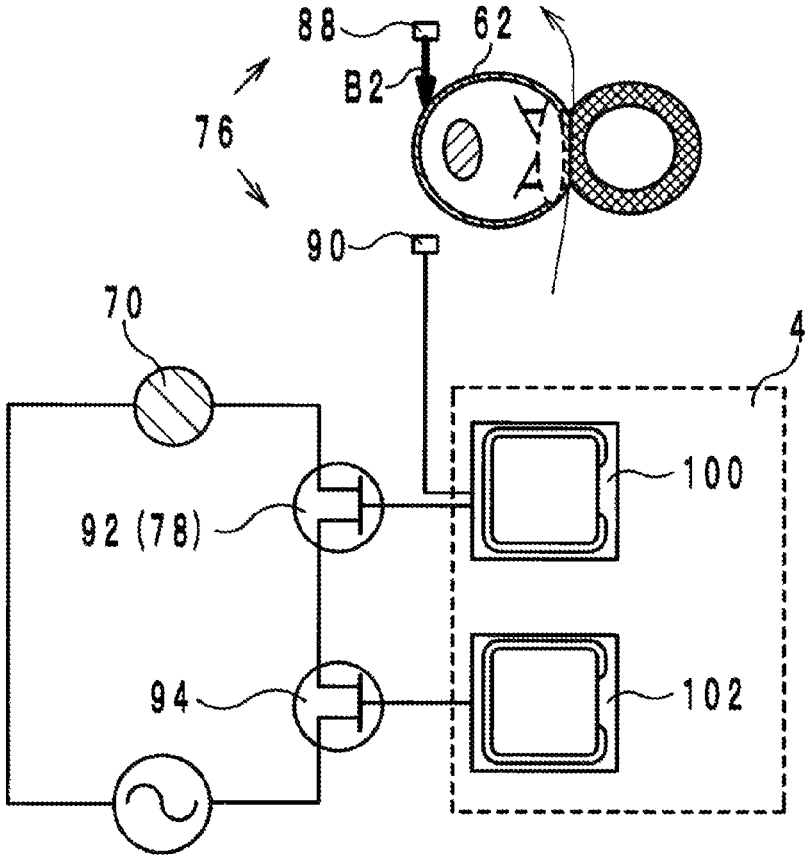
FIG. 9 is a schematic view illustrating a cross-section of the fuser according to a fourth embodiment, and a connection relationship with the power cut-off unit.
Figure 10:
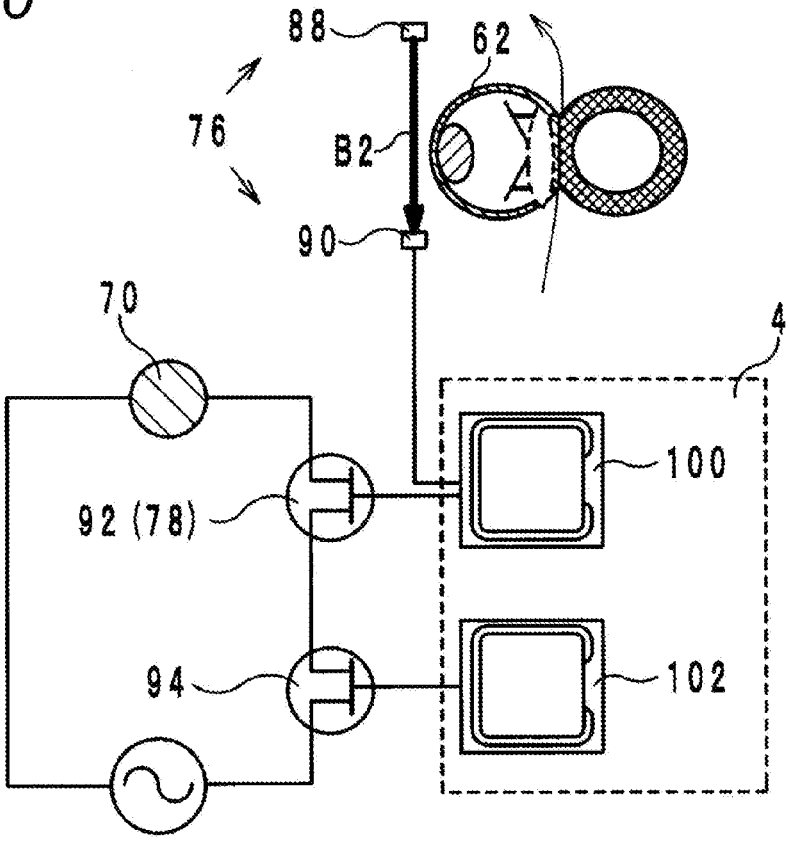
FIG. 10 is a schematic view illustrating the cross-section of the fuser according to the fourth embodiment, and a connection relationship with the power cut-off unit.

See FIGS. 9 and 10

An image forming apparatus 1D according to a fourth embodiment and the image forming apparatus 1A according to the first embodiment are different in configurations of the detection unit 76 and the power cut-off unit 78. Detailed description will be made below.

As illustrated in FIG. 9, a detection unit 76 according to the fourth embodiment includes an optical sensor having a set of a light emitting element 88 and a light receiving element 90 provided outside the fusing belt 62. The power cut-off unit 78 according to the fourth embodiment represents a triac 92 configured to control the power supply to the halogen heater 70. Here, the triac 92 is operated according to an ignition prevention control program of a sub CPU 100 provided at a control unit 4. It is noted that, in the image forming apparatus 1D, temperature control of the halogen heater 70 is performed by a triac 94 connected to a main CPU 102 provided at the control unit 4.

In the detection unit 76 and the power cut-off unit 78 according to the fourth embodiment, normally, an optical axis B2 of the light emitting element 88 crosses the outer peripheral surface of the fusing belt 62. That is, the fusing belt 62 blocks light from the light emitting element 88. Therefore, the light from the light emitting element 88 cannot be received by the light receiving element 90. In this condition, the triac 92 is on, and power is supplied to the halogen heater 70.

However, as illustrated in FIG. 10, when the fusing belt 62 is abnormally overheated and contracted, the optical axis B2 of the light emitting element 88 and the outer peripheral surface of the fusing belt 62 are uncrossed, the light from the light emitting element 88 is received by the light receiving element 90, and the light receiving element 90 transmits a signal to the sub CPU 100. In the sub CPU 100 receiving the signal, the ignition prevention control program is activated, and the triac 92 is turned off. Accordingly, power supply to the halogen heater 70 is stopped.

Even in the image forming apparatus 1D configured as described above, the abnormal overheating of the fusing belt 62 can be detected further accurately, and the ignition of the fusing belt 62 can be prevented.

Further, in the image forming apparatus 1D, the triac 92 configured to control the power supply to the halogen heater 70 is connected to the sub CPU 100, and the triac 94 configured to control the temperature is connected to the main CPU 102. Accordingly, in the image forming apparatus 1D, even if the main CPU 102 is out of control, an ignition prevention control program of the sub CPU 100 independent of the main CPU 102 is activated, and thus, the image forming apparatus 1D has higher safety than an image forming apparatus having one CPU to control the triacs 92 and 94. The other configurations of the present fourth embodiment are similar to those of the first embodiment. Accordingly, description of the present fourth embodiment is identical to that of the first embodiment except for the detection unit 76 and the power cut-off unit 78.

Fifth Embodiment

Figure 11:
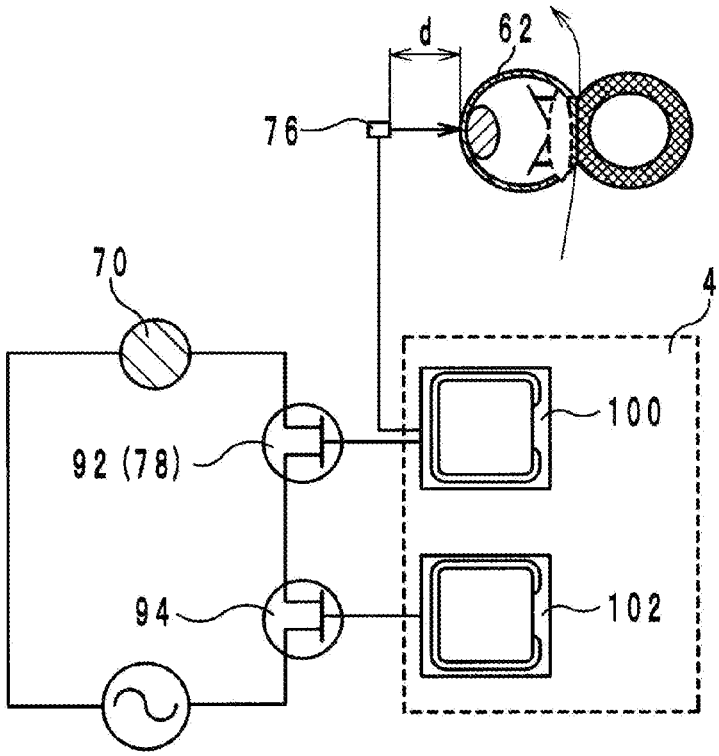
FIG. 11 is a schematic view illustrating a cross-section of the fuser according to a fifth embodiment, and a connection relationship with the power cut-off unit.

See FIG. 11

An image forming apparatus 1E according to a fifth embodiment is different from the image forming apparatus 1D according to the fourth embodiment in that the detection unit 76 of the fuser 60 is a distance sensor. Detailed description will be made below.

As illustrated in FIG. 11, in the detection unit 76 according to the fifth embodiment, the detection unit 76 provided outside the fusing belt 62 is a laser displacement meter, and a distance between the detection unit 76 and the outer peripheral surface of the fusing belt 62 is measured. Normally, the distance d between the detection unit 76 and the outer peripheral surface of the fusing belt 62 is maintained constant. In this condition, the triac 92 is on, and power is supplied to the halogen heater 70.

However, when the fusing belt 62 is abnormally overheated and contracted, the distance d between the detection unit 76 and the outer peripheral surface of the fusing belt 62 is increased. Then, when the distance d between the detection unit 76 and the outer peripheral surface of the fusing belt 62 exceeds a threshold, the detection unit 76 transmits a signal to the sub CPU 100. In the sub CPU 100 receiving the signal, the ignition prevention control program is activated, and the triac 92 is turned off. Accordingly, power supply to the halogen heater 70 is stopped.

Even in the image forming apparatus 1E configured as described above, the abnormal overheating of the fusing belt 62 can be detected further accurately, and the ignition of the fusing belt 62 can be prevented.

Further, in the image forming apparatus 1E, even if the main CPU 102 is out of control, the ignition prevention control program of the sub CPU 100 independent of the main CPU 102 is activated, and thus, the image forming apparatus 1E has higher safety than an image forming apparatus having one CPU to control the triacs 92 and 94. Another method of measuring the distance D by the detection unit 76 includes a method of measuring a distance from an exciting coil to the outer peripheral surface of the fusing belt 62, as the change of a capacitor component of an induction circuit, when the heat source of the fuser 60 uses IH. The other configurations of the present fifth embodiment are similar to those of the fourth embodiment. Accordingly, description of the present fifth embodiment is identical to that of the fourth embodiment except for the detection unit 76.

Other Embodiments

It should be understood that the fuser and the image forming apparatus according to the present invention are not limited to the above-mentioned embodiments, and various alterations or modification may be made without departing from the scope of the invention. For example, as the power cut-off unit, a transistor may be used in place of the relay. Further, the heat source is not limited to the halogen heater, and the fusing belt may include an arbitrary material. Still further, the detection unit or the power cut-off unit according to each embodiment may be combined.

As described above, the present invention is useful for a fuser and an image forming apparatus, and particularly, the present invention is superior in further accurately detecting abnormal overheating of a fusing belt, and preventing ignition of the fusing belt.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A fuser for thermally fixing a toner image on a recording medium, the fuser comprising:

an endless fusing belt configured to transfer heat to the toner image;

a heat source configured to heat the fusing belt;

a detection unit configured to detect peripheral inward deformation of the fusing belt; and a power cut-off unit configured to cut off power supplied to the heat source upon detection of the peripheral inward deformation of the fusing belt by the detection unit, wherein the detection unit is positioned on an inner peripheral side of the fusing belt, and wherein the detection unit has a rod-shaped member, and the rod-shaped member is disposed at a position where the rod-shaped member makes contact with part of the fusing belt deformed peripherally inward and moved peripherally inward.

2. The fuser according to claim 1, wherein the heat source is positioned on one side of an inner periphery of the fusing belt, a holding member configured to support the fusing belt is positioned on the other side of the inner periphery of the fusing belt, and the detection unit is positioned on the one side of the inner periphery of the fusing belt.

3. The fuser according to claim 1, wherein the power cut-off unit is a drive circuit driven according to a signal from the detection unit.

4. The fuser according to claim 1, wherein cutting off of the power supply by the power cut-off unit is performed based on a determination of a CPU connected with the detection unit.

5. An image forming apparatus comprising the fuser according to claim 1.

6. A fuser for thermally fixing a toner image on a recording medium, the fuser comprising:

an endless fusing belt configured to transfer heat to the toner image;

a heat source configured to heat the fusing belt;

a detection unit configured to detect peripheral inward deformation of the fusing belt; and a power cut-off unit configured to cut off power supplied to the heat source upon detection of the peripheral inward deformation of the fusing belt by the detection unit, wherein the detection unit is an optical sensor, and when part of the fusing belt deformed peripherally inward blocks an optical path of the optical sensor, peripheral inward deformation of the fusing belt is detected.

7. The fuser according to claim 6, wherein the heat source is positioned on one side of an inner periphery of the fusing belt, a holding member configured to support the fusing belt is positioned on the other side of the inner periphery of the fusing belt, and the detection unit is positioned on one end side of the fusing belt.

8. The fuser according to claim 6, wherein the power cut-off unit is a drive circuit driven according to a signal from the detection unit.

9. The fuser according to claim 6, wherein cutting off of the power supply by the power cut-off unit is performed based on a determination of a CPU connected with the detection unit.

10. An image forming apparatus comprising the fuser according to claim 6.

11. A fuser for thermally fixing a toner image on a recording medium, the fuser comprising:

an endless fusing belt configured to transfer heat to the toner image;

a heat source configured to heat the fusing belt;

a detection unit configured to detect peripheral inward deformation of the fusing belt; and a power cut-off unit configured to cut off power supplied to the heat source upon detection of the peripheral inward deformation of the fusing belt by the detection unit, wherein the detection unit is one of (i) a non-contact sensor positioned outside the fusing belt, the non-contact sensor being a sensor configured to detect a change in distance between the non-contact sensor and an outer peripheral surface of the fusing belt, and (ii) an optical sensor configured to detect uncrossing of an optical path of the optical sensor and an outer peripheral surface of the fusing belt based on the peripheral inward deformation of the fusing belt.

12. The fuser according to claim 11, wherein the heat source is positioned on one side of an inner periphery of the fusing belt, and a holding member configured to support the fusing belt is positioned on the other side of the inner periphery of the fusing belt.

13. The fuser according to claim 11, wherein the power cut-off unit is a drive circuit driven according to a signal from the detection unit.

14. The fuser according to claim 11, wherein cutting off of the power supply by the power cut-off unit is performed based on a determination of a CPU connected with the detection unit.

15. An image forming apparatus comprising the fuser according to claim 11.

* * * * *